US007329038B2

(12) United States Patent
Hashiba

(10) Patent No.: US 7,329,038 B2
(45) Date of Patent: Feb. 12, 2008

(54) MIXER

(75) Inventor: Tomohiko Hashiba, Minato-ku (JP)

(73) Assignee: Bio Media Co., Ltd., Tokyo (JP)

( * ) Notice: Subject to any disclaimer, the term of this patent is extended or adjusted under 35 U.S.C. 154(b) by 434 days.

(21) Appl. No.: 10/488,043

(22) PCT Filed: Aug. 28, 2002

(86) PCT No.: PCT/JP02/08660

§ 371 (c)(1),
(2), (4) Date: Aug. 2, 2004

(87) PCT Pub. No.: WO03/020435

PCT Pub. Date: Mar. 13, 2003

(65) Prior Publication Data

US 2004/0240311 A1 Dec. 2, 2004

(30) Foreign Application Priority Data

Aug. 29, 2001 (JP) ..... 2001-259160

(51) Int. Cl.
*B01F 13/02* (2006.01)
*B01F 15/00* (2006.01)

(52) U.S. Cl. ..... 366/101; 366/151.1; 366/163.2

(58) Field of Classification Search ..... 366/101, 366/151.1, 163.2
See application file for complete search history.

(56) References Cited

U.S. PATENT DOCUMENTS 2,701,164 A 2/1955 Purchas et al.
4,403,866 A 9/1983 Falcoff et al.
4,684,488 A 8/1987 Rudolph
6,155,457 A * 12/2000 Landa et al. ..... 222/94
6,390,453 B1 * 5/2002 Frederickson et al. ..... 261/26

FOREIGN PATENT DOCUMENTS

FR 751877 9/1933
JP 59-216652 12/1984

(Continued)

OTHER PUBLICATIONS

English translation of French patent 751 877, issued Sep. 11, 1933; 4 pages; corresponds to IDS document No. AL1, filed Jul. 20, 2005.

(Continued)

*Primary Examiner*—Tony G. Soohoo
(74) *Attorney, Agent, or Firm*—Sterne, Kessler, Goldstein & Fox P.L.L.C.

(57) ABSTRACT

A mixer capable of uniformly mixing a plurality of fluid materials without providing a mixing tank or an agitating vane. Different fluid raw materials are stored in raw material tanks, respectively. The raw materials are fed at a predetermined rate by variable restrictors so as to be supplied to a fluid supply hole of a nozzle. At this moment, the materials are not mixed. When the materials are discharged from a fluid discharge outlet, compressed air introduced from an air supply hole of the nozzle forms a high-speed vortex flow of the compressed air in front of the nozzle and the discharged raw materials are crushed into fine particles and mixed by this vortex flow, thereby obtaining a uniformly mixed material.

9 Claims, 6 Drawing Sheets

FOREIGN PATENT DOCUMENTS

| | | |
|---|---|---|
| JP | 62-023465 | 1/1987 |
| JP | 06-210209 | 8/1994 |
| JP | 10-008705 | 1/1998 |

OTHER PUBLICATIONS

English language patent abstract of Japanese Publication No. 59-216652, Japan Patent Office, 1 page, Publication Date Dec. 6, 1984.

English language patent abstract of Japanese Publication No. 62-023465, Japan Patent Office, 1 page, Publication Date Jan. 31, 1987.

English language patent abstract of Japanese Publication No. 10-008705, Japan Patent Office, 1 page, Publication Date Jan. 13, 1998.

English language patent abstract of Japanese Publication No. 06-210209, Japan Patent Office, 1 page, Publication Date Aug. 2, 1994.

English language partial translation of claim, JP Utility Model Application Disclosure No. 61-204667 of Dec. 23, 1986, Application No. 60-89359 of Jun. 13, 1985, 1 page.

* cited by examiner

MIXER

TECHNICAL FIELD

The present invention relates to a mixer for uniformly mixing a plurality of fluid materials such as coating materials, liquid medicines, oil, water, and the like one another.

BACKGROUND ART

Manufacturing steps of various products include a mixing process for uniformly mixing a plurality of fluid materials. As one example, in the manufacturing steps of a coating material, raw materials containing several types of coloring materials or pigments are mixed at a specific ratio in order to obtain a product having a desired color tone so that a color tone of a final product is obtained. In such a case, although it may be thought that when a product having the same color tone is produced again, predetermined raw materials are mixed at the mixing ratio identical to that at the previous time to obtain the same product, since the raw materials themselves actually have variations such as slightly different concentrations per lot, the final product having the color tone completely matched with that at the previous time cannot be obtained only by mixing at the predetermined mixing ratio. Conventionally, in compounding such coating materials, after they are once mixed at the predetermined mixing ratio, the color tone of the product is checked and then several raw materials are additionally put into a mixing tank according to the result thereof and agitated again to manufacture a coating material completely matched with a desired color tone.

However, in the above conventional technique, in the case of using commercially available coating materials, as can be easily imaged from that the materials are diluted for coating at an appropriate concentration by adding a solvent such as a reducer, a raw material having a remarkably high concentration and high viscosity has to be treated in a stage of mixing coating raw materials. Even when a plurality of fluid materials having a high viscosity are put into and agitated in the mixing tank, they have required a long agitating time to be uniformly mixed in a complete manner. Additionally, as described above, since it is required that after the agitating step is once terminated, the raw materials are additionally put into and agitated in the mixing tank for fine adjustment of the color tone, the agitating time is further made longer.

Further, as user's needs therefor have been increased in recent years, there exists a need for coating materials having various color tones as compared with conventionally in the coating material business. For example, dozens of coating materials having slightly different color tones are required to compound for white coating materials. Naturally, experiences and information on the compounding at the previous time are effectively reused so that a time for fine adjustment of color tones is omitted, but when a coating material having a novel color tone is ordered to manufacture from an automobile manufacturer, trial and error are required to repeat to a certain degree.

Furthermore, there is required that various coating materials are small produced depending on various user's needs. As described above, when brightness of colors is slightly different even in the same color tone, various types of coating materials are required to mix. After several coating materials having certain color tones are mixed, if a mixer such as a mixing tank or an agitating vane is not completely washed, it influences the color tones of the coating materials to be manufactured in the next step. The agitating device of the mixer for coating materials has a complicated shape and structure in order to agitate the raw materials having a high viscosity as efficiently as possible. A large quantity of human efforts is required for completely washing the agitating device or the mixing tank for each small-producing.

Therefore, it is an object of the present invention to provide a mixer capable of uniformly mixing a plurality of fluid materials without a mixing tank or an agitating vane.

DISCLOSURE OF THE INVENTION

A mixer for mixing a plurality of fluid materials with one another, having fluid characteristics of being fed in a pipe by a pressure difference between an upstream side and a downstream side inside the pipe according to a first aspect is characterized by comprising a nozzle having a fluid discharge outlet for discharging the fluid material, a fluid supply hole communicated with the fluid discharge outlet for supplying the fluid material to the fluid discharge outlet, a gas ejection hole formed around the fluid discharge outlet for forming a high-speed vortex flow of a gas in front of the fluid discharge outlet, and a gas supply hole communicated with the gas ejection hole for supplying the gas to the gas ejection hole, a fluid supply means for supplying each of the plurality of fluid materials to the fluid supply hole of the nozzle, the fluid supply means comprising a flow rate regulating means configured to be capable of regulating relative supply flow rates of the plurality of fluid materials, a gas supply means for supplying the gas to the gas supply hole of the nozzle, a mixed material characteristic detecting means for detecting characteristics of a mixed material which has been discharged in a coexistent state from the fluid discharge outlet of the nozzle, and crushed into fine particles by the high-speed vortex flow of the gas to be ejected in a uniformly mixed state, and a control means for controlling the flow rate regulating means according to a detection result by the mixed material characteristic detecting means.

In the mixer according to the first aspect, although a plurality of fluid materials supplied to the fluid supply hole of the nozzle are in a coexistent state where they have not been uniform at a point of time of being discharged from the fluid discharge outlet of the nozzle, they are crushed into fine particles by a high-speed vortex flow of the gas in front of the nozzle immediately after being discharged from the fluid discharge outlet and they are mixed with one another to be in a uniform mixed state.

Further, according to this mixer, a uniform mixed material can be obtained without providing a mixing tank or compounding tank with an agitating vane used for mixing a plurality of fluid materials in the conventional technique. That such a tank is not required means that an entire mixer is made as small as possible. When the types of the fluid materials to be mixed are changed, only the nozzle portion having a simple structure is washed in the present invention, and it is possible to remarkably reduce human efforts and rapidly change the materials as compared with the conventional technique where especially a mixing tank having a large capacity or an agitating vane having a complicated structure was manually washed. Further, in a mixer used for producing refreshments, medications, or cosmetics, although even when the types of the materials are not changed, all the constituent elements of the mixer are required to periodically sterilize for hygienic management from the nature of the products, it is possible to reduce efforts for sterilizing similar to washing at the time of changing materials in such a case, so that reduction of maintenance time possibly improves an operation efficiency of the mixer.

From such an aspect, in the mixer according to the first aspect, it is preferable that a structure of the pipe system from raw material tanks for storing fluid materials therein to the nozzle is made as simple as possible. Specifically, there is preferably configured so that a feed pump having a complicated structure is not included in the pipe system from the raw material tanks for storing the fluid materials therein to the nozzle, there is more preferably configured so that elements other than the flow rate regulating means are not included in the pipe system from the raw material tanks for storing fluid materials therein to the nozzle, and there is most preferably configured so that the flow rate regulating means is disposed at a position other than the pipe system from the raw material tanks for storing fluid materials therein to the nozzle.

In the mixer according to the first aspect, there is configured so that the characteristics of the resulting mixed material are detected by the mixed material characteristic detecting means and the control means controls the flow rate regulating means according to the detection result. The characteristics of the resulting mixed material are attributes different according to the nature of the mixed material or product to be obtained.

A mixer according to a second aspect is characterized in that the mixed material characteristic detecting means is configured with an optical sensor. The optical sensor here is typically configured with a light source for emitting a light beam toward the mixed material, and a light detecting means for detecting a light beam transmitted though the mixed material or a light beam reflected and/or scattered on the mixed material. A concept of the light beam includes a white light and all visible light beams having specific colors, and ultraviolet ray, near-infraredray, far-infraredray, and the like. A dedicated sensor may be used as the light detecting means when the light source is ultraviolet ray and the like, but a more general existing means, for example, a CCD sensor or color temperature is employed in the case of visible light beams. This mixer is applied to mixed materials whose characteristics are expressed by light beams reflected on the mixed materials or light beams transmitted through the mixed materials (conversely, absorbed in the mixed material).

According to the mixer of the second aspect, since there is configured so that the optical sensor is used as the mixed material characteristic detecting means to detect the characteristics of the resulting mixed material, when a principal or important attribute of a product which is a mixed material such as a paint coating material is color, white light is illuminated to the mixed material actually ejected to detect the reflected light by the color CCD sensor so that it can be known whether or not a mixed paint having a desired appropriate color tone has been obtained and that the control means regulates the mixing ratio to be correct according to the detection result by the optical sensor.

According to the mixer of the third aspect, there is configured so that the gas component sensor is used as the mixed material characteristic detecting means to detect the characteristics of the resulting mixed material, when a principal or important attribute of a product which is a mixed material such as perfume water is the volatile component, the volatile component contained in the mixed material actually ejected is detected by the odor sensor so that it can be known whether or not the perfume water having a desired appropriate perfume has been compounded and that the control means regulates the mixing ratio to be correct according to the detection result by the gas component sensor.

According to the mixer of the third aspect, there is configured so that the gas component sensor is used as the mixed material characteristic detecting means to detect the characteristics of the resulting mixed material, when a principal or important attribute of a product which is a mixed material such as perfume water is volatile component, the volatile component contained in the mixed material actually ejected is detected by the odor sensor so that it can be known whether or not the perfume water having a desired appropriate perfume has been compound and that the control means regulates the mixing ratio to be correct according to the detection result by the gas component sensor.

Further, a mixer according to a fourth aspect is characterized in that the mixed material characteristic detecting means is configured with a liquid component sensor for detecting a specific component in a liquid. The liquid component sensor here includes a salt content sensor or a sugar content sensor as a simple one, and a sensor, such as a palatable component sensor, capable of detecting a predetermined single component by immersing the sensor itself into a liquid which is a mixed material, and further includes a multi-component detecting means such as a chromatography analyzer as a complicated one.

According to the mixer of the fourth aspect, there is configured so that the liquid component sensor is used as the mixed material characteristic detecting means to detect the characteristics of the resulting mixed material, when a principal or important attribute of a product which is a mixed material such as refreshment is taste, the taste component contained in the mixed material actually ejected is detected by the salt content sensor or the sugar content sensor so that it can be known whether or not the refreshment having a desired appropriate taste has been compound and that the control means regulates the mixing ration to be correct according to the detection result by the liquid component sensor.

In the mixer according to the first aspect described above, there is configured so that the characteristics of the resulting mixed material are detected by the mixed material characteristic detecting means and the control means controls the flow rate regulating means according to the detection result. In this case, with respect to the detection of the characteristics of the mixed material, there is preferably configured the characteristics of the mixing material being actually ejected and obtained are preferably immediately detected, which makes the control feedback rapid.

A mixer according to a fifth aspect is characterized in that the mixed material characteristic detecting means is disposed so as to detect the characteristics of the mixed material present in an ejection path in front of the nozzle. In the mixer according to the fifth aspect, there is configured so that the mixed material characteristic detecting means is disposed such that the characteristics of the mixed material still floating in the space in the ejection path are detected immediately after being discharged from the nozzle. This is particularly suitable for employing a non-contact type detecting means such as the above optical sensor.

According to the mixer of the fifth aspect, since there is configured so that the mixed material characteristic detecting means is disposed such that the characteristics of the mixed material are detected immediately after being ejected from the nozzle, the flow rate regulating means can be rapidly controlled according to the detection result by the means, thereby improving the response speed of the control.

Further, a mixer according to a sixth aspect is characterized in that the mixed material characteristic detecting means comprises a receiving surface disposed in front of the nozzle for receiving the ejected mixed material. In the mixer according to the sixth aspect, there is configured so that a receiving tray such as a tray is disposed in front of the nozzle so as to receive the mixed material ejected from the nozzle, and the mixed material characteristic detecting means is attached to the receiving means such as this tray. In such a structure, since the receiving surface of the receiving means such as the tray can be secured to be relatively large, the structure is suitable for attaching a plurality of mixed material characteristic detecting means. Further, since the mixed material ejected from the nozzle is spread toward the end and discharged into a large area, when he/she wants to store the mixed material into a small bottle to be produced, there is advantageously configured so that the mixed material is discharged into a predetermined container via a discharge hole or the like of the tray.

Further, a mixer according to a seventh aspect is characterized in that the control means controls the flow rate regulating means such that the characteristic of the mixed material detected by the mixed material characteristic detecting means matches with a predetermined setting value. In the mixer according to the seventh aspect, a setting value for specifying the characteristic of the mixed material to be obtained is previously registered in the control means. This setting value is specifically, for example, a value of RGB component of a color indicating a color tone of a paint which is a mixed material, or a concentration of an organic solvent to be mixed into the paint.

According to the mixer of the seventh aspect, since there is configured so that when the mixed material where a plurality of fluid materials are mixed at a predetermined constant ratio is obtained, the flow rate regulating means is controlled by feeding back the characteristic of the mixed material detected by the mixed material characteristic detecting means, even when the viscosity of any one of fluid materials is changed due to a change in the ambient temperature so that the mixing ratio is varied, the flow rate regulating means is controlled so as to eliminate the variation so that the mixed material having desired characteristics can be always mixed and obtained in a stable manner.

Here, when the control means controls the flow rate regulating means, if the mixed material characteristic detecting means is attached to the product tank for storing the resulting mixed materials, a time delay sometimes occurs until the characteristic of the mixed material is fed back. Further, there is also a time delay element originally present in the mixer itself such as a pipe led to the fluid discharge outlet of the nozzle. Further, the time delay element is contained when a sensor whose response speed is slow is employed as the mixed material characteristic detecting means or when a means which requires a certain degree of time until the analysis result is output, such as a chromatography device, is employed.

A mixer according to an eighth aspect is characterized in that the control means controls the flow rate regulating means by performing PI control or PID control with respect to the characteristic of the mixed material detected by the mixed material characteristic detecting means. In the mixer according to the eighth aspect, since the control loop is a PI control or PID control system when feedback-controlling the flow rate regulating means on the basis of the characteristic of the mixed material detected by the mixed material characteristic detecting means, influences due to the time delay elements are eliminated, thereby further improving the stability of the characteristic of the resulting mixed material.

According to the mixer of the eighth aspect, it is possible to eliminate the influences due to the time delay elements and to improve the stability of the control system by a closed-loop control by the PI control or PID control, and to further improve the quality of the resulting mixed material.

Further, a mixer according to a ninth aspect is characterized in that the control means further comprises a pattern output means for outputting a pattern of a change in order to change the characteristic of the mixed material to be ejected according to a proceeding of the ejection step, and that the control means controls the flow rate regulating means such that the characteristic of the mixed material follows the output value of the pattern output means.

In the mixer according to the ninth aspect, dynamic control is performed as compared with the mixer according to the sixth and seventh aspects which performs static control in order to obtain a mixed material having a characteristic of a predetermined constant setting value. More specifically, for example, there is configured so that a storage means for storing characteristics of a sample (original or specimen) on the characteristics of the mixed material to be ejected is incorporated in the control means and parameters for describing the characteristics of the original sample are sequentially read from the storage means to be output as the patterns of changes, or the pattern output means is configured so that as the stage of ejecting the mixed material is advanced, a data table stored in the storage means is referred to according to the proceeding to be output as patterns or that the changes in the patterns are described in formulas and the calculation results are output as the patterns.

According to the mixer of the ninth aspect, for example, when perfumes are mixed and manufactured in the mixer, many types of perfume water whose perfume components are stepwise changed can be continuously compounded. Further, when watercolors for drawing are mixed and manufactured in the mixer, many types of watercolors whose brightness is stepwise changed to be brighter while maintaining the same color tones can be continuously compounded. Further, when a coated material is disposed in front of the nozzle, pattern painting such as gradation can be applied to the coated material.

In this manner, the mixer according to the present invention is basically directed for ejecting and storing the ejected mixed materials into containers for selling as products (including semimanufactured products) or storage containers of products, but can employ various applications, for example, the mixer can be used as a coater as it is when the mixed material is directly ejected to a coated material in the case where the mixed material is a coating material, and can be used as a device for coating a resin film in the case where the mixed material is resin.

BEST MODES FOR CARRYING OUT THE INVENTION

Figure 1:
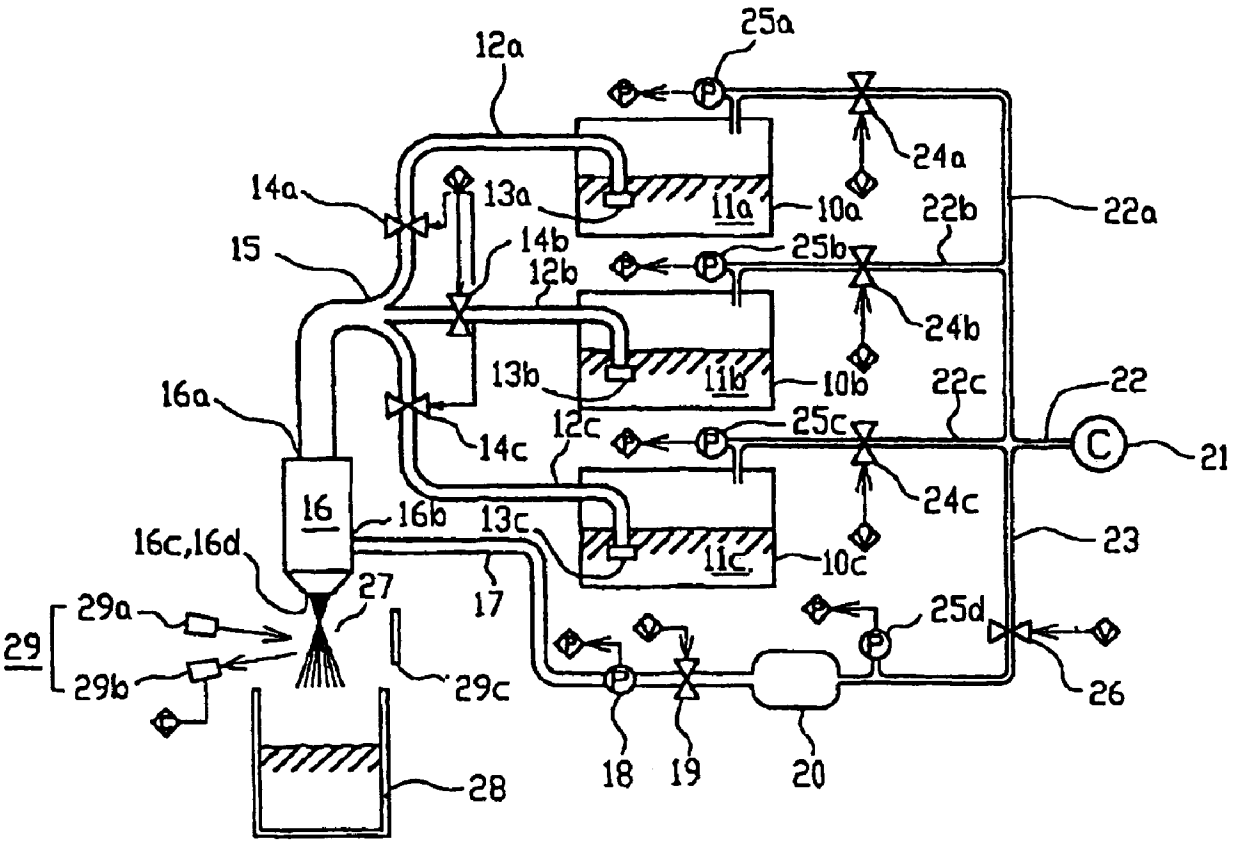
FIG. 1 is an entire configuration diagram showing a mixer according to a first embodiment of the present invention.

Hereinafter, embodiments of a mixer according to the present invention will be described. In the description, like reference numerals are denoted to the like elements, and repeated description will be omitted. Here, the reference numerals are as follows. 10*a* to 10*c*: raw material tank (fluid material tank), 11*a* to 11*c*: coating raw material (fluid material), 14*a* to 14*c*: solenoid variable restrictor (flow rate regulating means), 16: nozzle, 18: pneumatic sensor, 19: pressure regulating valve, 20: compressed air reservoir, 21: compressor, 24*a* to 24*c*: solenoid valve, 25*a* to 25*c*: pneumatic sensor, 26: solenoid valve, 27: mixed material, 29: optical sensor (mixed material characteristic detecting means), 30: control device (control means), 31: display device, 32: input device, 35: pH sensor, 36: sugar content sensor, 41: casing, 42: core, 43: opening hole (gas ejection hole), 44: hole (gas supply hole), 45: pipe (air supply pipe), 53: hole (fluid supply hole), 55: hole (fluid discharge outlet), 56: spiral body, 57: vortex flow chamber, and 59: spiral groove A first embodiment according to the present invention will be described. FIG. 1 is a diagram showing an entire structure of the mixer. As illustrated, this mixer is configured as a coating material compounder for mixing a plurality of coating raw materials which contain different coloring matters or pigments, respectively, and compounding a coating material having a desired color tone.

A raw material tank 10*a* is a fluid material tank for storing a coating raw material 11*a* as a fluid raw material, and is configured as a sealable pressure tight container, where a predetermined opening lid (not shown) is opened and an appropriate quantity of coating raw material 11*a* is injected therein before starting to mix the raw materials, and then the opening lid is sealed. The mixer is provided with raw material tanks 10*b* and 10*c* having the same structure as this raw material tank 10*a*, which contain coating raw materials 11*b* and 11*c* having different color tones from each other, respectively.

There is attached inside the raw material tank 10*a* a fluid feed pipe 12*a* penetrating the wall of the tank from the outside of the tank to the inside of the tank, and an end portion of the fluid feed pipe 12*a* is disposed to reach the vicinity of the bottom of the raw material tank 10*a*, and a strainer 13*a* is attached at the end portion. A tip end outside the raw material tank 10*a* of the fluid feed pipe 12*a* is combined to one of the three branch pipes in a branch pipe 15 via a solenoid variable restrictor 14*a* as a flow rate regulating means. The other branch pipes in the branch pipe 15 are attached with fluid feed pipes 12*b* and 12*c* via solenoid variable restrictors 14*b* and 14*c* similarly configured as in the above description to be led to the raw material tanks 10*b* and 10*c*, respectively. The branch pipe 15 causes the three branch pipes to be combined into one pipe having a slightly large inner diameter, and the tip end thereof is combined to a fluid supply hole 16*a* of a nozzle 16 having a structure described later in detail.

A gas supply hole 16*b* of the nozzle 16 is combined with an air supply pipe 17 as a gas supply means, and is sequentially combined with a pneumatic sensor 18, pressure regulating valve 19, and a compressed air reservoir 20 toward the upstream side at an opposite side of the nozzle 16 in the pipe.

The compressor 21 is directed for generating compressed air, and the compressed air output is discharged to a pressure pipe 22, and then is branched into pressure pipes 22*a*, 22*b*, 22*c*, and 23 via several combination sections. The pressure pipes 22*a* to 22*c* are pipes for introducing compressed air into upper spaces inside the raw material tanks 10*a* to 10*c*, respectively, and are provided with solenoid valves 24*a* to 24*c* in the middle of the pipes, respectively, and are provided with pneumatic sensors 25*a* to 25*c* for detecting air pressures inside the upper spaces of the raw material tanks 10*a* to 10*c*, respectively. The pressure pipe 23 is a pipe for introducing compressed air into the compressed air reservoir 20, and is provided with a solenoid valve 26 in the middle of the pipe, and is provided with a pneumatic sensor 25*d* for detecting an air pressure inside the compressed air reservoir 20.

There are provided at the tip end portion of the nozzle 16 a fluid discharge outlet 16*c* communicated with the fluid supply hole 16*a* and a gas ejection hole 16*d* formed around the fluid discharge outlet 16*c*. Three types of coating raw materials 11*a* to 11*c* supplied to the fluid supply hole 16*a* via the above branch pipe 15 are discharged from the fluid discharge outlet 16*c* in a coexistent state where the raw materials have not been uniformly mixed yet, but a high-speed vortex flow of the air ejected from the gas ejection hole 16*d* is formed in front of (below in the drawing) the nozzle 16, and the coating raw materials 11*a* to 11*c* discharged in the coexistent state are crushed into fine particles and ejected to a product container 28 as a mixed material 27 in a sprayed form in a state of being uniformly mixed with one another along with the vortex flow.

An optical sensor 29 as a mixed material characteristic detecting means composed of a white light source 29*a* and a color CCD sensor 29*b* is disposed beside the ejection path where the coating raw materials 11*a* to 11*c* are mixed by the high-speed vortex flow of the air and led to the product container 28, and a light shielding plate 29*c* for shielding influences due to outside light is disposed at an opposite side of the mixed material 27, where the mixed material 27 in the ejection path is illuminated by a white light emitted from the white light source 29*a* and a light reflected on the mixed material 27 in the sprayed form is picked up by the color CCD sensor 29*b* to detect a color tone of the mixed material 27.

Figure 2:
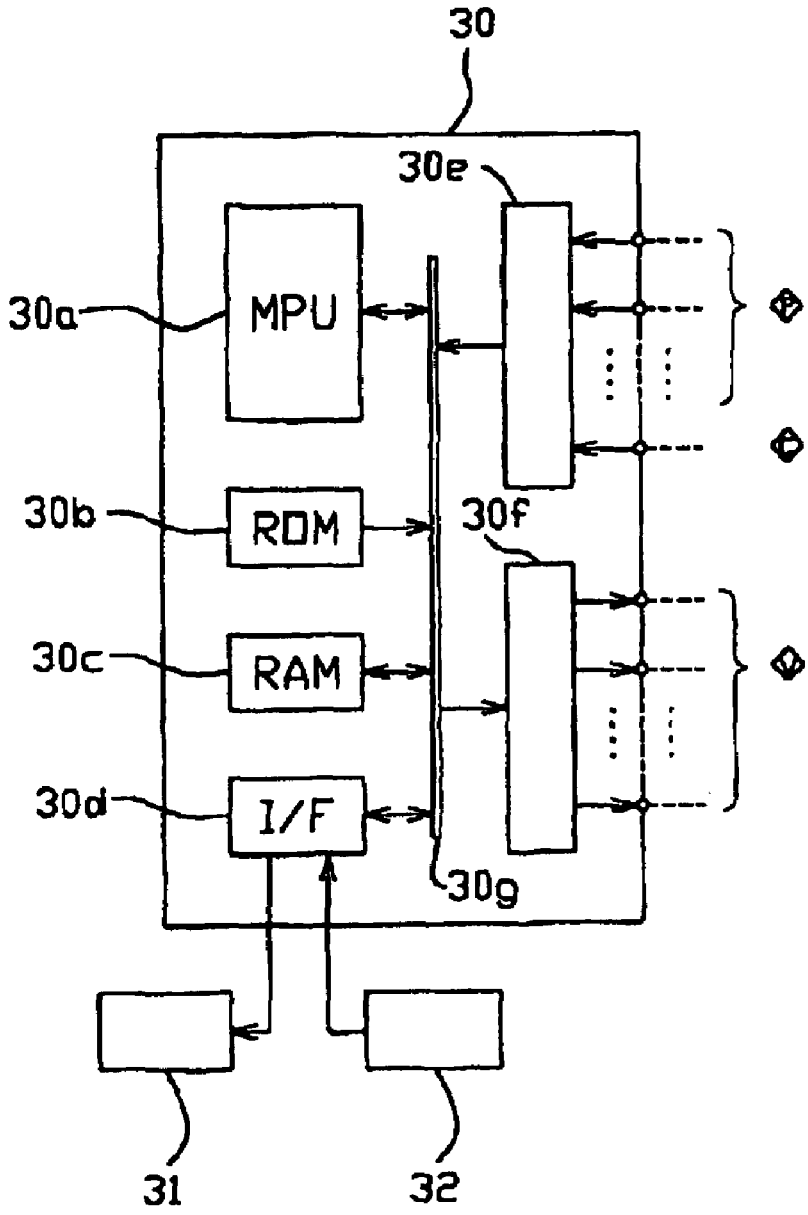
FIG. 2 is a block diagram showing a structure of a control device according to the embodiment in FIG. 1.

As shown in FIG. 2, a control device 30 incorporates a MPU 30*a*, an EP-ROM 30*b* storing a program to be executed by the MPU therein, a RAM 30*c*, an interface unit 30*d*, an A/D converter 30*e* for receiving signals from the pressure sensors, and a drive unit 30*f* for solenoid drive of the valves therein, and these are interconnected via a bus line 30*g*. A display device 31 such as a CRT is connected to an output port of the interface unit 30*d*, and an input device 32 such as a keyboard is connected to an input port thereof.

The respective pneumatic sensors of the mixer, that is, outputs obtained from the pneumatic sensors 18 and 25*a* to 25*d* are connected to an input of the A/D converter 30*e* of the control device, which converts analog values of the air pressures detected by these pneumatic sensors into digital values. The values of the air pressures converted into the digital values are read by the MPU 30*a* via the bus line 30*g*.

The respective solenoid drive valves of the mixer, that is, the solenoid variable restrictors 14*a* to 14*c* and the solenoid valves 24*a* to 24*c* and 26 are connected to an output of the drive unit 30*f* of the control device 30, and the drive unit 30*f* regulates a current for the solenoid drive according to an instruction from the MPU 30*a*, and performs ON/OFF switching.

Figure 3A:
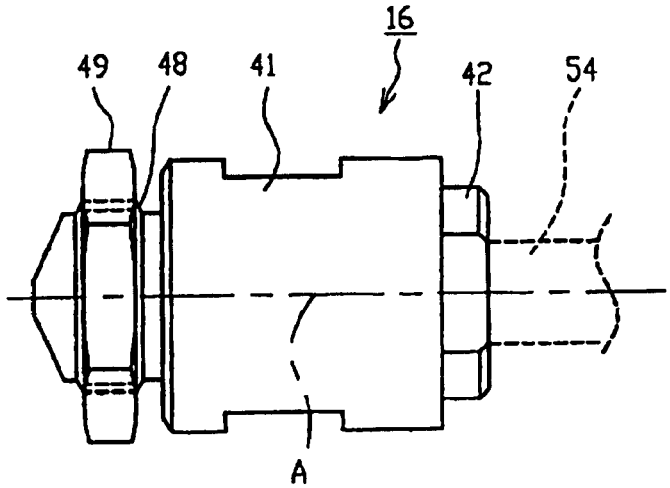
FIG. 3A is a plan view showing a nozzle according to the embodiment in FIG. 1.
Figure 3B:
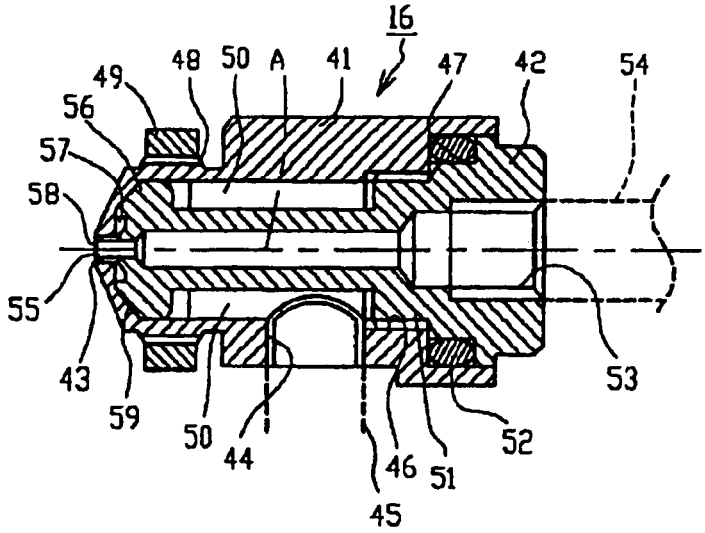
FIG. 3B is a cross-sectional view showing the nozzle according-to the embodiment in FIG. 1.

Next, a structure of the nozzle 16 will be described with reference to FIG. 3A, FIG. 3B, and FIG. 4. FIG. 3A is a plan view of the nozzle, FIG. 3B is a cross-sectional view of the nozzle, and FIG. 4 is a front view of the nozzle.

The nozzle 16 is configured so that a substantially cylindrical core 42 is inserted and screwed into a substantially cylindrical hollow casing 41. The casing 41 is manufactured by machining a metal material such as stainless steel or brass, and is formed at the tip end thereof with an opening hole 43 having a circular cross-section whose center matches with a center axis line A of the nozzle 16 to form an outside contour of the gas ejection hole 16*d*. A hole 44 as the gas supply hole 16*b* is protruded at the side of the casing 41 so as to have an axis line orthogonal to the center axis line A of the nozzle 16. A female screw groove is provided at an inner surface of this hole 44 so that a pipe 45 which is the air supply pipe 17 can be screwed therein and combined therewith. A female screw groove 46 is formed at the base portion in the inner surface of the casing 41, and a step section 47 having a slightly large inner diameter is formed in the direction of the base portion. Further, a male screw groove 48 is formed at an outer surface of the tip end of the casing 41, and a fixing nut 49 for attaching the nozzle 16 can be screwed therein.

The core 42 is manufactured by machining a metal material identical to or different from the above casing 41, and the inside thereof is hollowed along the center axis line A to be hollow. Further, the outer diameter thereof has a size by which the core can be fit into the hollow hole of the casing 41, and the outer diameter in the vicinity of the substantially center in the longitudinal direction is made slightly smaller so that an annular-cylindrical space 50 remains with respect to the inner surface of the casing 41. This space 50 is communicated with the hole 44 provided in the above casing 41, and a gas such as compressed air is introduced therein via the hole 44. A male screw groove 51 is provided at an outer periphery in slightly front of the base portion of the core 42, and is screwed with the above female screw groove 46 to fix the core 42 inside the casing 41. Further, the portion at the base portion is made slightly larger than the screw groove 51 and sandwiches an O-ring seal 52 with respect to the above step section 47 to secure airtightness of the above space 50. A female screw groove is provided at the inner diameter of a hole 53 at the base portion of the core 42, and screws and combines a pipe 54 at the tip end of the branch pipe 15 therein. A hole 55 as the fluid discharge outlet communicated through the inside hollow space from the hole 54 as the fluid supply hole at the base portion is opened to the tip end of the core 42, and a remarkably large part of substantially conical shape therearound is formed as a spiral body 56. A vortex flow chamber 57 is formed between the tip end surface of the spiral body 56 and the inner surface at the tip end of the casing 41. A tip end surface 58 of the core 42 constituting the vortex flow chamber 57 has a gap with respect to an opening hole 43 of the above casing 41, which constitutes the gas ejection hole 16*d*.

Figure 4:
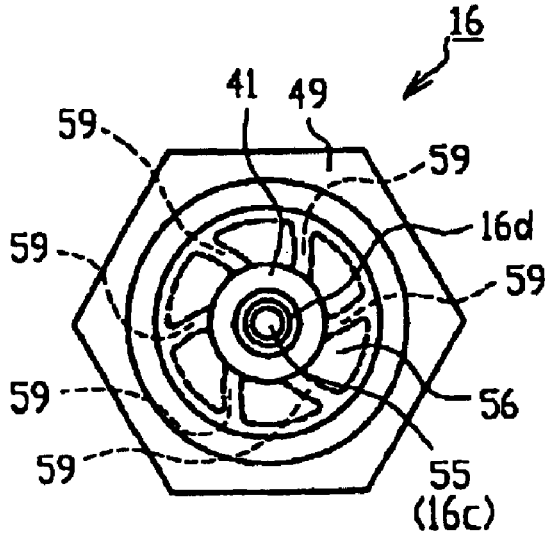
FIG. 4 is a front view showing the nozzle according to the embodiment in FIG. 1.

With reference to the front view of the nozzle 16 shown in FIG. 4, the hole 55 as the circular fluid discharge outlet 16*c* is disposed at the center, and the annular gas ejection hole 16*d* is disposed therearound. This gas ejection hole 16*d* is communicated with a plurality of spiral grooves 59 extending in a spiral manner which are formed at the conical surface of the spiral body 56 disposed inside the casing 41.

A gas such as compressed air supplied from the hole 44 as the gas supply hole 16*d* passes through the space 50 and is compressed to be a high-speed vortex flow when passing through the spiral groove 59 having small cross-section area formed in the spiral body 56. This high-speed vortex flow is made to a spiral flow inside the vortex flow chamber 57 and ejected from the restricted annular gas ejection hole 16*d* to form a high-speed vortex flow of the gas in front of the nozzle 16. This vortex flow is formed into a tapered conical shape where the front position closer to the tip end of the casing 41 is focused.

Here, a fluid material is supplied to the hole 53 as the fluid supply hole 16*a* via the pipe 54. The fluid material discharged from the hole 55 as the fluid discharge outlet 16*c* passing through the hollow portion of the core 42 from the hole 53 is crushed into fine particles by the high-speed vortex flow of the gas ejected from the gas ejection hole 16*d*, is forcibly mixed along with the rotation of the vortex flow, and is discharged in the sprayed form forward the nozzle 16 as a mixed material of the uniformly mixed fine particles. As illustrated, clogging of the fluid material does not occur even when the inner diameter of the hole 55 is made slightly smaller than the inner diameter of the hollow hole of the core 42, but the inner diameter of the hole 55 may be the same diameter as the inner diameter of the hollow hole.

Next, a method for using the mixer according to the present embodiment configured as described above will be described.

When an operator starts to mix coating materials, he/she selects types of coating materials to be mixed from a menu screen displayed on the display device 31. Since a composition of the coating materials previously compound has been stored in the EP-ROM 30*b*, when the product code is input from the keyboard 32, an instruction screen for the operator is displayed on the screen of the display device 31, where the code numbers and the quantities of the coating raw materials to be put into the respective raw material tanks 10*a* to 10*c* are instructed. Further, when information for specifying a color tone of a completed product for the coating materials to be newly compound, for example, a RGB value or YMC value is input from the keyboard 32, the MPU 30*a* performs operation while referring to the characteristic values of various coating raw materials stored in the EP-ROM 30*b*, and calculates the-types and the quantities of the coating raw materials to be put into the respective raw material tanks 10*a* to 10*c* to be displayed on the screen of the display device 31. The MPU 30*a* further stores the values which are assumed to be detected by the color CCD sensor 29*b* as the color tones in the RAM 30*c* when the coating raw materials are appropriately mixed.

After the operator puts the designated quantities of the designated coating raw materials into the respective raw material tanks 10*a* to 10*c* as instructed by the display device 31 and firmly closes the lids of the tanks, he/she instructs to start mixing from the keyboard 32. When this instruction is received, the MPU 30*a* issues an instruction to the drive unit 30*f* and opens the solenoid valve 24*a*, and monitors an output of the pneumatic sensor 25*a* via the A/D converter 30*e*, and waits until the compressed air from the compressor 21 fills the upper space of the raw material tank 10*a* to reach the predetermined pressure (in the initial state, other solenoid valves in the mixer are closed). When it is confirmed that a pressure inside the tank has been increased to the predetermined air pressure by the pneumatic sensor 25*a* of the raw material tank 10*a*, the MPU 30*a* closes the solenoid valve 24*a*, and opens the solenoid valve 24*b* leading from the compressor 21 to the raw material tank 10*b* to increase the air pressure inside the raw material tank 10*b* to the predetermined pressure. The pressure at this time is sometimes different from the pressure in the raw material tank 10*a*. This is because the raw material stored in the raw material tank 10*a* and the raw material stored in the raw material tank 10*b* are remarkably different in the viscosity or in the flow rate to be compounded (that is to be discharged from the tank) in some cases. In this manner, when the solenoid valves 24*a* to 24*c* are sequentially opened to increase the inner pressures of the raw material tanks 10*a* to 10*c* to the predetermined pressure, and then the solenoid valve 26 is opened to increase the inner pressure of the compressed air reservoir 20 to the predetermined pressure, the conditions for mixing start are completed.

When the MPU 30*a* determines that the conditions for mixing start have been completed, the MPU 30*a* opens the pressure regulating valve 19. Then, the compressed air is supplied from the compressed air reservoir 20 to the gas supply hole 16*b* of the nozzle 16 so that the high-speed vortex flow of the air is ejected from the gas ejection hole 16*d* at the tip end of the nozzle 16. Next, the MPU 30*a* opens the solenoid variable restrictors 14*a* to 14*c* by a predetermined opening. Then, the coating raw materials 11*a* to 11*c* stored in the raw material tanks 10*a* to 10*c* are supplied from the fluid feed pipes 12*a* to 12*c* to the fluid supply hole 16*a* of the nozzle 16 via the branch pipe 15 at the mixing ratio according to the openings of the three solenoid variable restrictors 14*a* to 14*c*, and discharged from the fluid discharge outlet 16*c* at the tip end of the nozzle 16 in the coexistent state. The coating raw materials 11*a* to 11*c* discharged in front of the nozzle 16 are crushed into fine particles by the high-speed vortex flow of the air formed in front of the nozzle 16, and completely mixed with one another along with the vortex flow to be discharged to the product container 28 as the uniform mixed material 27.

When the mixing operation as described above is started, the MPU 30*a* monitors an output from the color CCD sensor 29 via the A/D converter 30*e*. A color tone of the mixed material 27 in the sprayed form in front of the nozzle 16 has been obtained as the RGB value from the color CCD sensor 29*b*. The MPU 30*a* compares this detected RGB value and the RGB value previously stored in the RAM 30*c*, and automatically controls the solenoid variable restrictors 14*a* to 14*c* such that the error thereof is zero. This control loop is realized in software by a program stored in the ROM 30*b* to be executed by the MPU 30*a*, and various control elements of the PID are contained in the feedback loop thereof, which appropriately treats the time delay element configured by the branch pipe 15, for example.

As the mixing of the raw materials is advanced, the fluid levels of the coating raw materials 11*a* to 11*c* inside the raw material tanks 10*a* to 10*c* are lowered, and the volumes of the upper spaces inside the raw material tanks 10*a* to 10*c* are increased accordingly, respectively, so that the air pressures in the portions are lowered. The pressure changes are detected by the pneumatic sensors 25*a* to 25*c*, and the MPU 30*a* which has detected the fact changes over the solenoid valves 24*a* to 24*c* to an opened state for an appropriate time to maintain the air pressures inside the raw material tanks 10*a* to 10*c* at the predetermined appropriate values. Similarly, the pressure of the compressed air inside the compressed air reservoir 20 is maintained at the predetermined appropriate value by controlling the solenoid valve 25*d*.

With the above operations, the mixed coating material having a color tone designated by the operator can be obtained in the product container 28. Since the mixed coating material stored in the product container 28 has been already uniformly agitated in a complete manner at the stage of being discharged as the mixed material 27 in the sprayed form from the nozzle 16, further agitating is not required. Further, although the nozzle 16 is required to be washed before compounding the coating materials having other color tones in the next step, since the nozzle 16 is simply configured and is small in size, it is put into an ultrasonic wave washing vessel to be completely washed in a short time so that it does not require much time. The raw material tanks 10*a* to 10*c*, the fluid feed pipes 12*a* to 12*c*, and the solenoid variable restrictors 14*a* to 14*c* are required to be washed when other types of coating raw materials 11*a* to 11*c* are stored, but they are used as dedicated to the respective coating materials when the number of types of the coating raw materials is not so many, so that they are not required to be washed.

Figure 5:
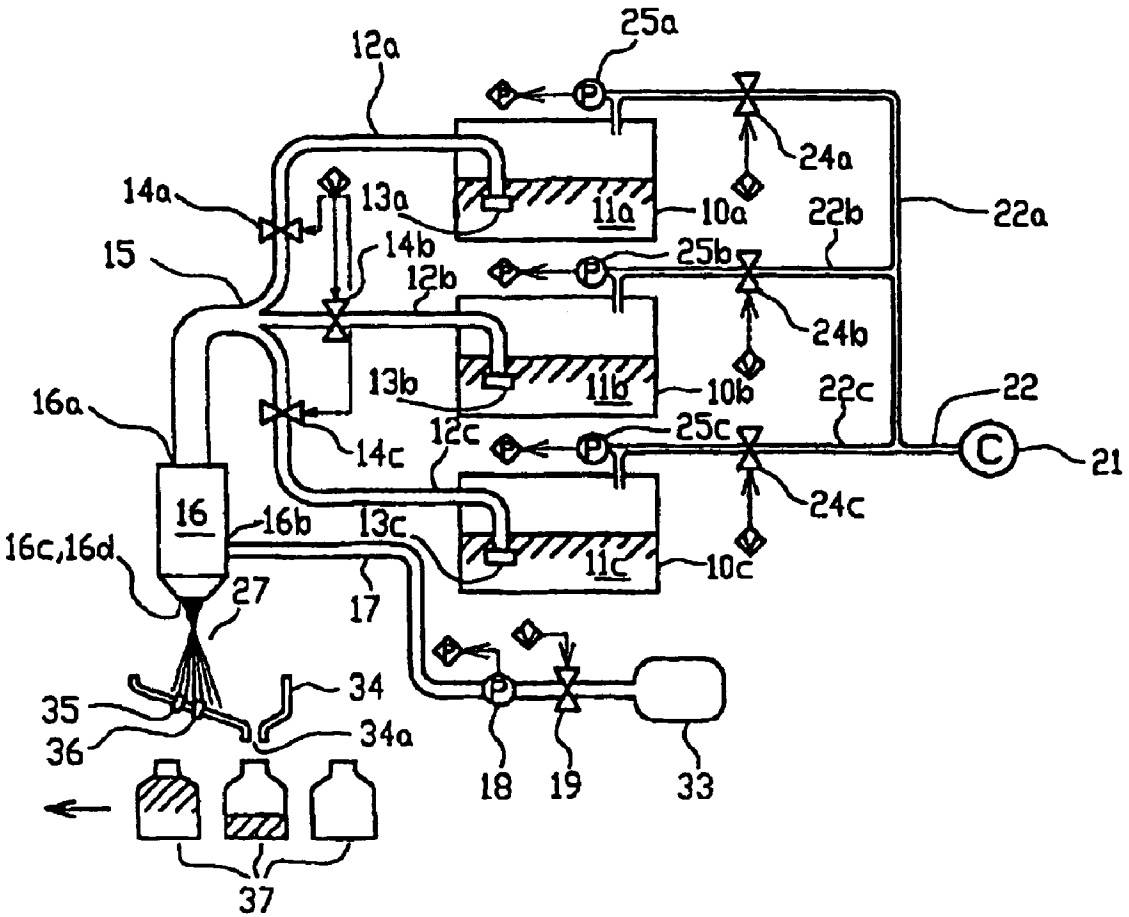
FIG. 5 is an entire configuration diagram showing a mixer according to a second embodiment of the present invention.

Next, a mixer according to a second embodiment of the present invention will be described with reference to FIG. 5. The mixer according to this embodiment is configured as a device for compounding a carbonated beverage containing fruit juice, where concentrated juice, freshwater, and vitamin C solution are stored in the raw material tanks 10*a* to 10*c*, respectively.

Although the gas ejected from the gas ejection hole 16*d* of the nozzle 16 was compressed air in the above embodiment, a CO2 gas is ejected from a gas cylinder 33 in the present embodiment. The concentrated juice 11 a having a high viscosity stored in the raw material tank 10*a* is discharged together with the freshwater 11*b* and the vitamin C solution 11*c* at a predetermined rate from the fluid discharge outlet 16*c* of the nozzle 16 to be crushed into fine particles by the high-speed vortex flow of the CO2 gas and to be uniformly mixed with one another. Furthermore, at the same time, the CO2 gas is solved into the mixed material 27 in the form of fine particles so that the mixed material 27 can be obtained as a carbonated beverage.

In the present embodiment, the mixed material 27 is received in a tray 34 as a receiving means disposed below the nozzle 16. A pH sensor 35 and a sugar content sensor 36 as the mixed material characteristic detecting means are disposed at the portion for receiving the spray of the mixed material 27 at the upper surface of the tray 34. The pH sensor 35 is used for detecting a concentration of carbon dioxide in the mixed material 27, and the sugar content sensor 36 is used for detecting a concentration of the concentrated juice in the mixed material 27. The control device 30 has a structure similar to that as shown in FIG. 2, and monitors the detection results by the pH sensor 35 and the sugar content sensor 36 to control such that a constant mixed material 27 can be always obtained. Therefore, the mixed material 27 having the constant concentrations of the concentrated juice (sugar content) and carbonic acid is always produced. The resulting mixed material 27 is discharged from the discharge outlet 34*a* of the tray 34 to be filled in a small bottle 37, and is shipped as a beverage.

The present invention is not limited to the above embodiments, and can be employed for various mixing applications such as mixing of cosmetics such as perfume water or emulsion, compounding of oily products (for example, mixing of grade A crude oil and grade C crude oil).

Further, when the optical sensor according to the first embodiment described above is configured as an infrared sensor so as to detect an absorption ratio of infrared ray in a mixed material, a sugar content contained in the mixed material can be also known.

Further, a gas component sensor shown in the following can be employed as the mixed material characteristic detecting means according to the above embodiments. The gas component sensor here includes, for example, an alcohol sensor, a sensor for detecting a carbon monoxide gas or organic solvent gas, and the like, and further includes an odor sensor being developed in recent years. In this case, when a principal or important attribute of a product which is a mixed material such as perfume water is volatile component, the volatile component contained in the mixed material actually ejected is detected by the odor sensor so that it can be known whether or not the perfume water having a desired perfume has been compounded and that the control means can regulate the composition ratio to be correct according to the detection result by the gas component sensor.

Further, a liquid component sensor for detecting a specific component in a liquid shown in the following can be employed as the mixed material characteristic detecting means according to the above embodiments. The liquid component sensor here includes, for example, a salt content sensor or a sugar content sensor as a simple one, and a sensor such as a palatable component sensor capable of detecting a predetermined single component by immersing the sensor itself into a liquid which is a mixed material, and further includes a multi-component detecting means such as a chromatography analyzer as a complicated one. In this case, when a principal or important attribute of a product which is a mixed material actually ejected is taste, the taste components contained in the mixed material actually ejected are detected by the salt content sensor or the sugar content sensor so that it can be known whether or not a refreshment having desired appropriate tastes has been compounded and that the control means can regulate the composition ratio to be correct according to the detection result by the liquid component sensor.

INDUSTRIAL APPLICABILITY

According to the invention of the first aspect, a uniform mixed material can be obtained without providing a mixing tank or compounding tank with an agitating vane used for mixing a plurality of fluid materials in the conventional technique.

Further, according to the invention of the second aspect, since there is configured so that the optical sensor is used as the mixed material characteristic detecting means to detect the characteristics of the resulting mixed material, when a principal or important attribute of a product which is a mixed material such as a paint coating material is color, a white light is illuminated to the mixed material actually ejected to detect the reflected light by the color CCD sensor so that it can be known whether or not a mixed paint having a desired appropriate color tone has been obtained and that the control means regulates the mixing ratio to be correct according to the detection result by the optical sensor.

Further, according to the invention of the third aspect, there is configured so that the gas component sensor is used as the mixed material characteristic detecting means to detect the characteristics of the resulting mixed material, when a principal or important attribute of a product which is a mixed material such as perfume water is volatile component, the volatile component contained in the mixed material actually ejected is detected by the odor sensor so that it can be known whether or not the perfume water having a desired appropriate perfume has been compound and that the control means regulates the mixing ratio to be correct according to the detection result by the gas component sensor.

Further, according to the invention of the fourth aspect, there is configured so that the liquid component sensor is used as the mixed material characteristic detecting means to detect the characteristics of the resulting mixed material, when a principal or important attribute of a product which is a mixed material such as refreshment is taste, the taste component contained in the mixed material actually ejected is detected by the salt content sensor or the sugar content sensor so that it can be known whether or not the refreshment having a desired appropriate taste has been compound and that the control means regulates the mixing ration to be correct according to the detection result by the liquid component sensor.

Further, according to the invention of the fifth aspect, since there is configured so that the mixed material characteristic detecting means is disposed such that the characteristics of the mixed material are detected immediately after being ejected from the nozzle, the flow rate regulating means can be rapidly controlled according to the detection result by the means, thereby improving the response speed of the control.

According to the invention of the sixth aspect, since there is configured so that the mixed material characteristic detecting means is disposed at the-receiving means for receiving the ejected mixed material, when a plurality of mixed material characteristic detecting means are disposed to detect the characteristics of the mixed material, a degree of freedom of the detecting means is widened.

According to the invention of the seventh aspect, since there is configured so that when the mixed material where a plurality of fluid materials are mixed at a predetermined constant ratio is obtained, the flow rate regulating means is controlled by feeding back the characteristic of the mixed material detected by the mixed material characteristic detecting means, even when the viscosity of any one of fluid materials is changed due to a change in the ambient temperature so that the mixing ratio is varied, the flow rate regulating means is controlled so as to eliminate the variation so that the mixed material having desired characteristics can be always mixed and obtained in a stable manner.

Further, according to the invention of the eighth aspect, it is possible to eliminate the influences due to the time delay elements and to improve the stability of the control system by a closed-loop control by the PI control or PID control, and to further improve the quality of the resulting mixed material.

Further, according to the invention of the ninth aspect, for example, when perfumes are mixed and manufactured in the mixer, many types of perfume water whose perfume components are stepwise changed can be continuously compound.

The invention claimed is:

1. A mixer for mixing a plurality of fluid materials together, having fluid characteristics of being fed in a pipe by a pressure difference between an upstream side and a downstream side inside the pipe, comprising:

a nozzle having a fluid discharge outlet for discharging the fluid material, a fluid supply hole communicated with the fluid discharge outlet for supplying the fluid material to the fluid discharge outlet, a gas ejection hole formed around the fluid discharge outlet for forming a high-speed vortex flow of a gas in front of the fluid discharge outlet, and a gas supply hole communicated with the gas ejection hole for supplying the gas to the gas ejection hole;

a fluid supply means for supplying each of the plurality of fluid materials to the fluid supply hole of the nozzle, the fluid supply means comprising a flow rate regulating means configured to be capable of regulating relative supply flow rates of the plurality of fluid materials;

a gas supply means for supplying the gas to the gas supply hole of the nozzle;

a mixed material characteristic detecting means for detecting characteristics of a mixed material which has been discharged in a coexistent state from the fluid discharge outlet of the nozzle, and crushed into fine particles by the high-speed vortex flow of the gas to be ejected in a uniformly mixed state; and a control means for controlling the flow rate regulating means according to a detection result by the mixed material characteristic detecting means.

2. A mixer according to claim 1, wherein the mixed material characteristic detecting means is configured with an optical sensor.

3. A mixer according to claim 1, wherein the mixed material characteristic detecting means is configured with a gas component sensor for detecting a specific gas.

4. A mixer according to claim 1, wherein the mixed material characteristic detecting means is configured with a liquid component sensor for detecting a specific component in a liquid.

5. A mixer according to any one of claims 1 to 4, wherein the mixed material characteristic detecting means is disposed so as to detect the characteristics of the mixed material present in an ejection path in front of the nozzle.

6. A mixer according to any one of claims 1 to 4, wherein the mixed material characteristic detecting means comprises a receiving surface disposed in front of the nozzle for receiving the ejected mixed material.

7. A mixer according to claim 1, wherein the control means controls the flow rate regulating means such that the characteristic of the mixed material detected by the mixed material characteristic detecting means matches with a predetermined setting value.

8. A mixer according to claim 7, wherein the control means controls the flow rate regulating means by performing PI control or PhD control with respect to the characteristic of the mixed material detected by the mixed material characteristic detecting means.

9. A mixer according to claim 1, wherein the control means further comprises a pattern output means for outputting a pattern of a change in order to change the characteristic of the mixed material to be ejected according to a proceeding of an ejection step, and the control means controls the flow rate regulating means such that the characteristic of the mixed material detected by the mixed material characteristic detecting means follows an output value of the pattern output means.

* * * * *

UNITED STATES PATENT AND TRADEMARK OFFICE

CERTIFICATE OF CORRECTION

PATENT NO. : 7,329,038 B2
APPLICATION NO. : 10/488043
DATED : February 12, 2008
INVENTOR(S) : Tomohiko Hashiba It is certified that error appears in the above-identified patent and that said Letters Patent is hereby corrected as shown below:

Column 3
Beginning at Line 58, the following paragraph should be added:

--Further, a mixer according to a third aspect is characterized in that the mixed material characteristic detecting means is configured with a gas component sensor for detecting a specific gas. The gas component sensor here includes, for example, an alcohol sensor or a sensor for detecting a carbon monoxide gas or an organic solvent gas, and further includes an odor sensor being developed in recent years--.

Column 4
Lines 4-15, the paragraph in Column 4, beginning on line 4, "According to the mixer of the third aspect..." should be deleted as it is a duplicate.

Column 16
Line 10, please replace "PI control or PhD control" with --PI control or PID control--.

Signed and Sealed this

Fifteenth Day of July, 2008

JON W. DUDAS
*Director of the United States Patent and Trademark Office*